US011566766B2

(12) United States Patent
Abe

(10) Patent No.: US 11,566,766 B2
(45) Date of Patent: Jan. 31, 2023

(54) VEHICLE LAMP

(71) Applicant: STANLEY ELECTRIC CO., LTD., Tokyo (JP)

(72) Inventor: Kazuki Abe, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/687,224

(22) Filed: Mar. 4, 2022

(65) Prior Publication Data

US 2022/0290831 A1 Sep. 15, 2022

(30) Foreign Application Priority Data

Mar. 10, 2021 (JP) ..... JP2021-038674

(51) Int. Cl.

| | |
|---|---|
| ***F21V 9/00*** | (2018.01) |
| ***F21S 41/24*** | (2018.01) |
| ***F21S 41/148*** | (2018.01) |
| ***F21S 41/32*** | (2018.01) |

(52) U.S. Cl.

CPC ..... *F21S 41/24* (2018.01); *F21S 41/148* (2018.01); *F21S 41/322* (2018.01)

(58) Field of Classification Search

CPC ..... F21S 41/24; F21S 41/322; F21S 41/143; F21S 41/27; F21S 41/265; F21V 7/0091; G02B 6/0015; G02B 6/0018

See application file for complete search history.

(56) References Cited

U.S. PATENT DOCUMENTS

| | | | | |
|---|---|---|---|---|
| 10,215,359 | B2 * | 2/2019 | Lisowski | B60Q 1/2665 |
| 2014/0177249 | A1 * | 6/2014 | Iseki | B60R 1/12 362/511 |
| 2017/0009952 | A1 * | 1/2017 | Tai | F21S 41/322 |
| 2018/0003878 | A1 * | 1/2018 | Del Carmen Montano | B60Q 1/0011 |

FOREIGN PATENT DOCUMENTS

| | | | | |
|---|---|---|---|---|
| FR | 2864606 | A1 * | 7/2005 | F21S 48/1154 |
| JP | S63-048884 | Y2 | 12/1988 | |
| JP | 2015-185296 | A | 10/2015 | |

* cited by examiner

*Primary Examiner* — Omar Rojas Cadima

(74) *Attorney, Agent, or Firm* — Kenealy Vaidya LLP

(57) ABSTRACT

A vehicle lamp includes a light source provided on one surface of a board and a light guide body that guides light emitted from the light source, the light guide body has an incidence section located on a side of the light guide body facing the one surface of the board, an emitting section located on a side opposite to the side facing the one surface of the board, and a light guide section located between the incidence section and the emitting section, and the light guide section has a portion that extends across inside and outside a region where the light guide body overlaps with the board when seen in a plan view, that extends at an outer side of the region, and that extends from one side toward the other side of the board in at least a thickness direction of the board.

19 Claims, 8 Drawing Sheets

VEHICLE LAMP

CROSS-REFERENCE TO RELATED APPLICATION

Priority is claimed on Japanese Patent Application No. 2021-038674, filed Mar. 10, 2021, the content of which is incorporated herein by reference.

BACKGROUND OF THE INVENTION

Field of the Invention

The present invention relates to a vehicle lamp.

Description of Related Art

In the related art, as a vehicle lamp mounted on a vehicle, a configuration in which a light source such as a light emitting diode (LED) or the like and a light guide body such as an inner lens or the like are combined is known (for example, see Japanese Utility Model Publication No. S63-48884 and Japanese Unexamined Patent Application, First Publication No. 2015-185296).

In such a vehicle lamp, light emitted from the light source enters the light guide body from a light incidence surface of the light guide body, and light is emitted to the outside of the light guide body from a light emitting surface of the light guide body while the light is guided inside the light guide body. Accordingly, the light can be emitted using the light emitting surface of the light guide body as a light emitting surface of the vehicle lamp.

SUMMARY OF THE INVENTION

Incidentally, in the above-mentioned vehicle lamp, there are side markers configured to emit orange light toward sides of the vehicle. The side markers are often installed in a narrow space on the sides of the vehicle, and it is required to make the entire lighting tool thinner according to the installation space.

For example, in the invention disclosed in Japanese Utility Model Publication No. S63-48884, the lens is made to emit light while reflecting the light emitted from the light source using a reflector. However, in the case of the above-mentioned configuration, the reflector increases the thickness of the entire lighting tool. In addition, the position of the lens facing the light source appears to shine stronger than the surroundings, in so called point lighting, which worsens the appearance of the vehicle lamp when lit.

Meanwhile, in the invention disclosed in Japanese Unexamined Patent Application, First Publication No. 2015-185296, the light emitted from the light source enters from one end side of the light guide body, the light is reflected toward a front surface side of the light guide body by a plurality of reflection cuts provided on a back surface side of the light guide body while the light is guided toward the other end side of the light guide body, and the light emitting surface of the light guide body emits light uniformly. However, in the case of such a configuration, a board on which the light source is mounted must be disposed in a direction perpendicular to a main surface of the light guide body on a side where the light is emitted, which increases the thickness of the entire lighting tool.

An aspect of the present invention is directed to providing a vehicle lamp capable of achieving reduction in the entire thickness and improving the appearance when it emits light.

The present invention provides the following configurations.

(1) A vehicle lamp according to an aspect of the present invention includes:

a light source provided on one surface of a board; and a light guide body configured to guide light emitted from the light source, wherein the light guide body has:

an incidence section located on a side of the light guide body facing the one surface of the board and from which the light emitted from the light source enters;

an emitting section located on a side opposite to the side facing the one surface of the board and through which light that has entered from the incidence section is emitted to an outside; and a light guide section that is located between the incidence section and the emitting section and that is configured to guide light from the incidence section toward the emitting section, the incidence section is disposed inside of a region where the light guide body overlaps with the board when seen in a plan view, the emitting section is disposed outside of the region where the light guide body overlaps with the board when seen in the plan view, and the light guide section has a portion that extends across the inside and the outside of the region where the light guide body overlaps with the board when seen in the plan view, that extends at an outer side of the region where the light guide body overlaps with the board when seen in the plan view, and that extends from one side toward other side of the board in at least a thickness direction of the board.

(2) In the vehicle lamp of the aspect of the above-mentioned (1), a direction of the light emitted from the light source matches with a direction of light emitted from the emitting section.

(3) In the vehicle lamp of the aspect of the above-mentioned (1) or (2), a dimension of the portion that extends from the one side toward the other side of the board is maximized in the light guide body in a thickness direction of the light guide body.

(4) In the vehicle lamp of the aspect of any one of the above-mentioned (1) to (3), the light guide body includes at least:

a first light guide section, a second light guide section, a third light guide section and a fourth light guide section;

a first reflecting section that is located between the first light guide section and the second light guide section and that is configured to reflect light, which has been entered from the incidence section and which is guided inside of the first light guide section, toward the second light guide section;

a second reflecting section that is located between the second light guide section and the third light guide section and that is configured to reflect light, which is guided inside of the second light guide section, toward the third light guide section;

a third reflecting section that is located between the third light guide section and the fourth light guide section and that is configured to reflect light, which is guided inside of the third light guide section, toward the fourth light guide section; and a fourth reflecting section that is located on a back surface side of the fourth light guide section and that is configured to reflect light, which is guided inside of the fourth light guide section, toward a front surface side of the fourth light guide section, and the third light guide section constitutes the portion that extends from the one side toward the other side of the board.

(5) In the vehicle lamp of the aspect of the above-mentioned (4), the fourth reflecting section has a plurality of reflection cuts provided on the back surface side of the fourth light guide section, and the plurality of reflection cuts reflect light, which is guided from one end side toward other end side of the fourth light guide section, toward the front surface side of the fourth light guide section.

(6) In the vehicle lamp of the aspect of the above-mentioned (5), the light guide body includes:

a fifth light guide section and a sixth light guide section;

a fifth reflecting section that is located between the fourth light guide section and the fifth light guide section and that is configured to reflect light, which is guided toward the front surface side of the fourth light guide section, toward the fifth light guide section; and a sixth reflecting section that is located between the fifth light guide section and the sixth light guide section and that is configured to reflect light, which is guided inside of the fifth light guide section, toward the sixth light guide section, the sixth reflecting section has a plurality of reflection cuts, and the plurality of reflection cuts are constituted by a first reflection cut configured to reflect light in one direction at a front surface side of the sixth light guide section and a second reflection cut configured to reflect light in another direction different from the one direction at the front surface side of the sixth light guide section, which are alternately arranged.

(7) In the vehicle lamp of the aspect of the above-mentioned (6), a transmissive surface configured to transmit light is provided on an end portion of the sixth light guide section corresponding to the other end side of the fourth light guide section.

(8) The vehicle lamp of the aspect of any one of the above-mentioned (1) to (7) includes a diffusion lens disposed so as to face the emitting section of the light guide body, wherein the diffusion lens has a diffusion surface configured to diffuse and transmit the light emitted from the emitting section.

According to the aspects of the present invention, it is possible to provide a vehicle lamp capable of achieving reduction in the entire thickness and improving the appearance when it emits light.

DETAILED DESCRIPTION OF THE INVENTION

Figure 1:
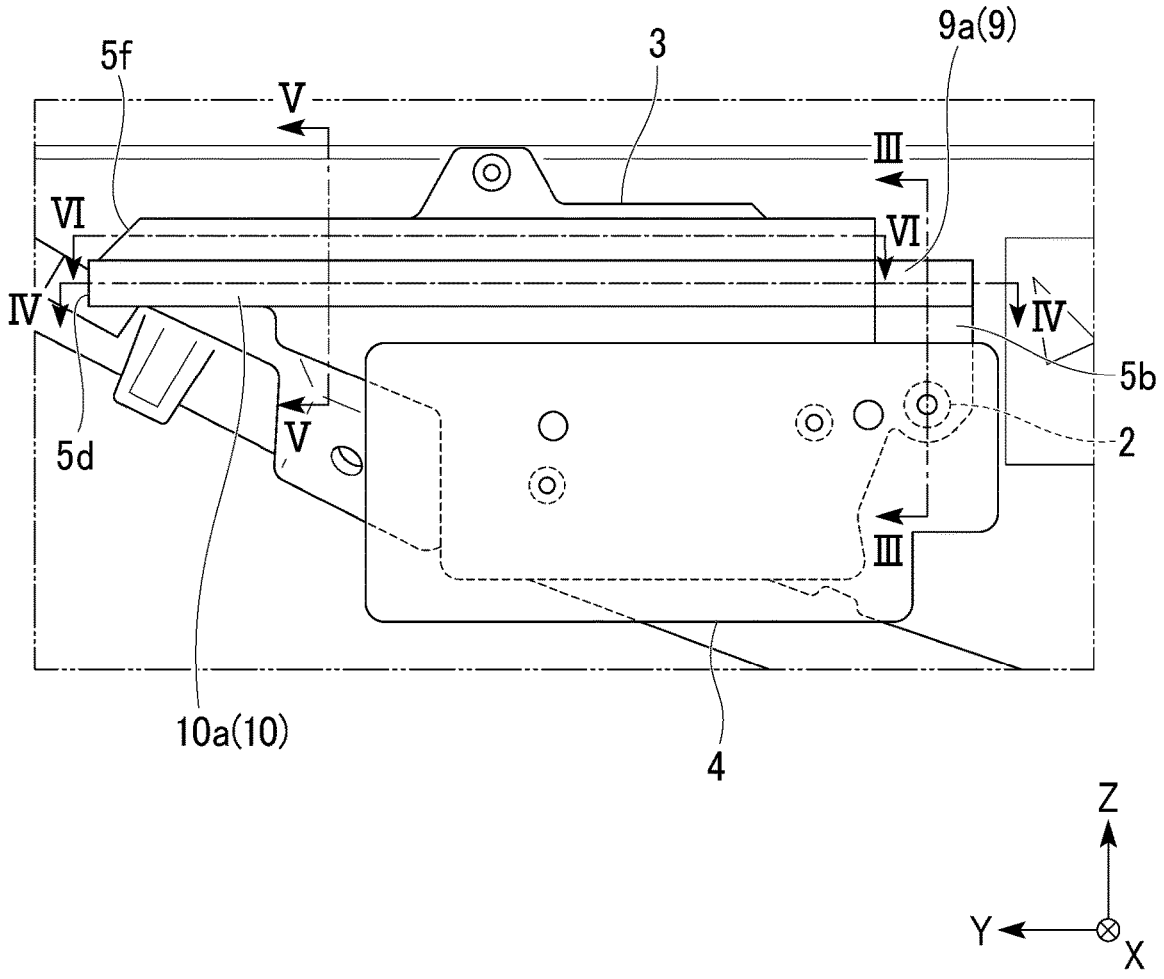
FIG. 1 is a rear view showing a configuration of a vehicle lamp according to an embodiment of the present invention.

Hereinafter, an embodiment of the present invention will be described in detail with reference to the accompanying drawings.

Further, in the drawings used in the following description, in order to make components easier to see, scales of dimensions may be shown differently depending on the components, and dimensional ratios of the components are not necessarily the same as the actual ones.

Figure 2:
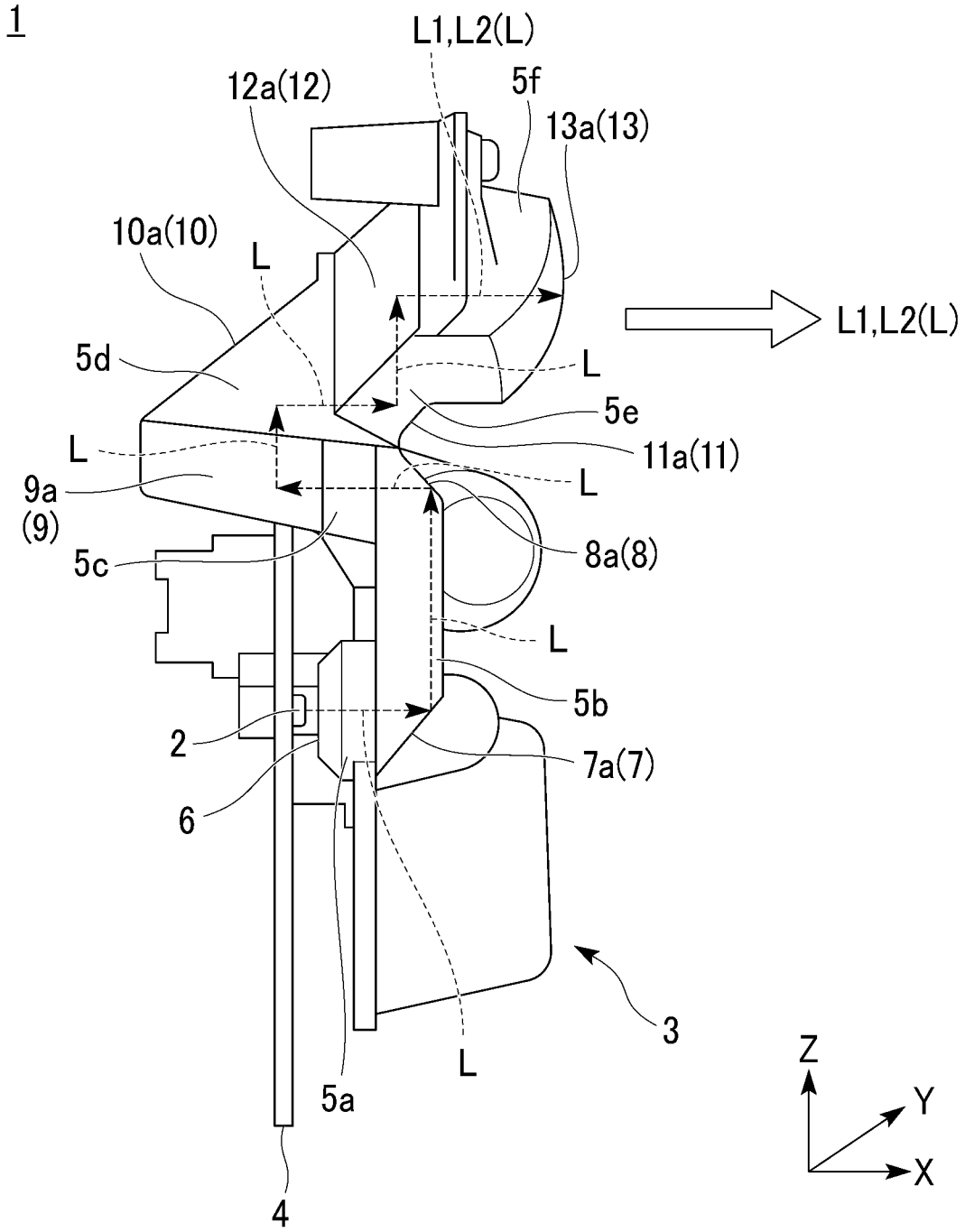
FIG. 2 is a side view showing the configuration of the vehicle lamp shown in FIG. 1.
Figure 3:
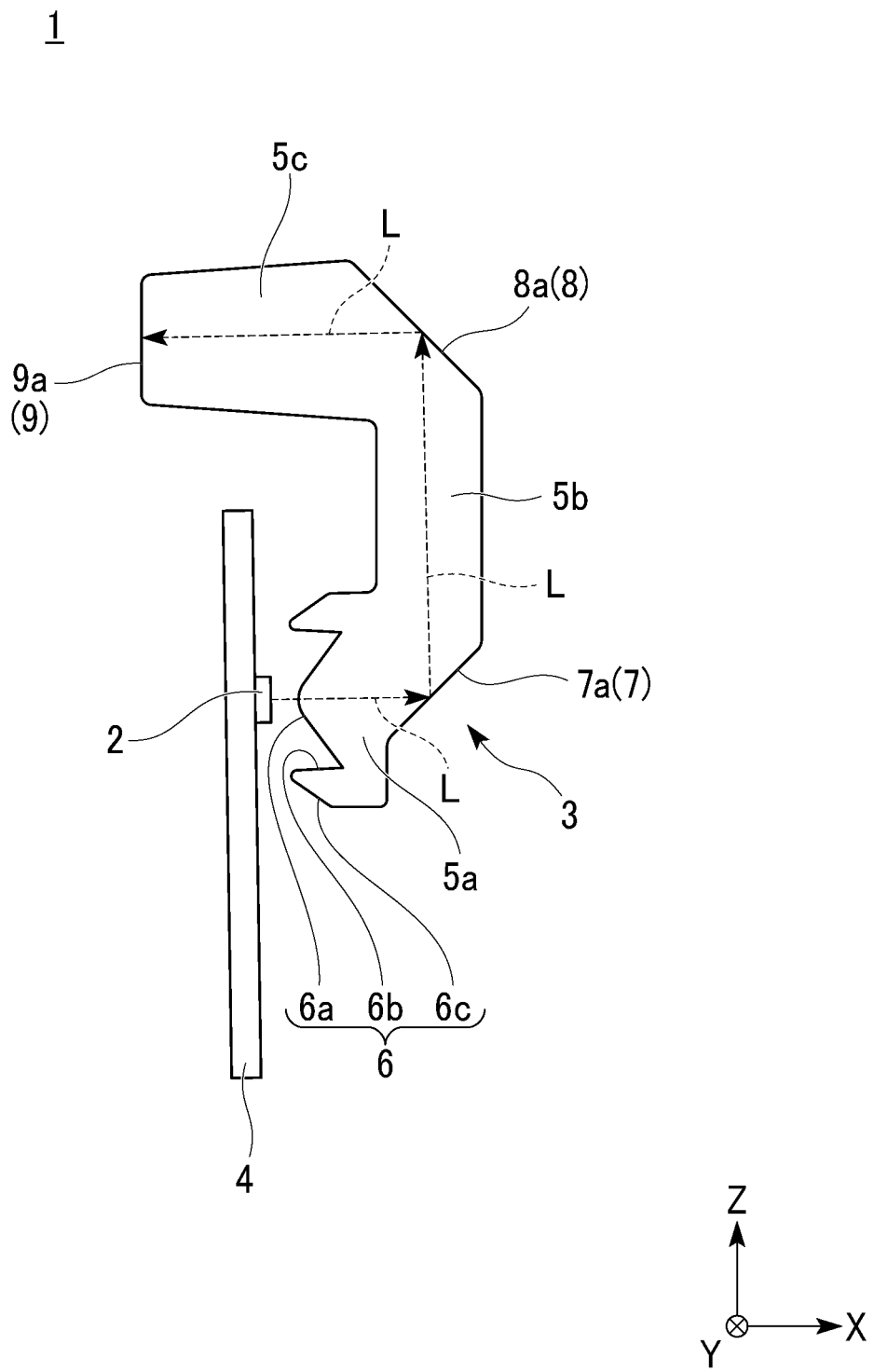
FIG. 3 is a cross-sectional view of the vehicle lamp along line segment III-III shown in FIG. 1.
Figure 4:
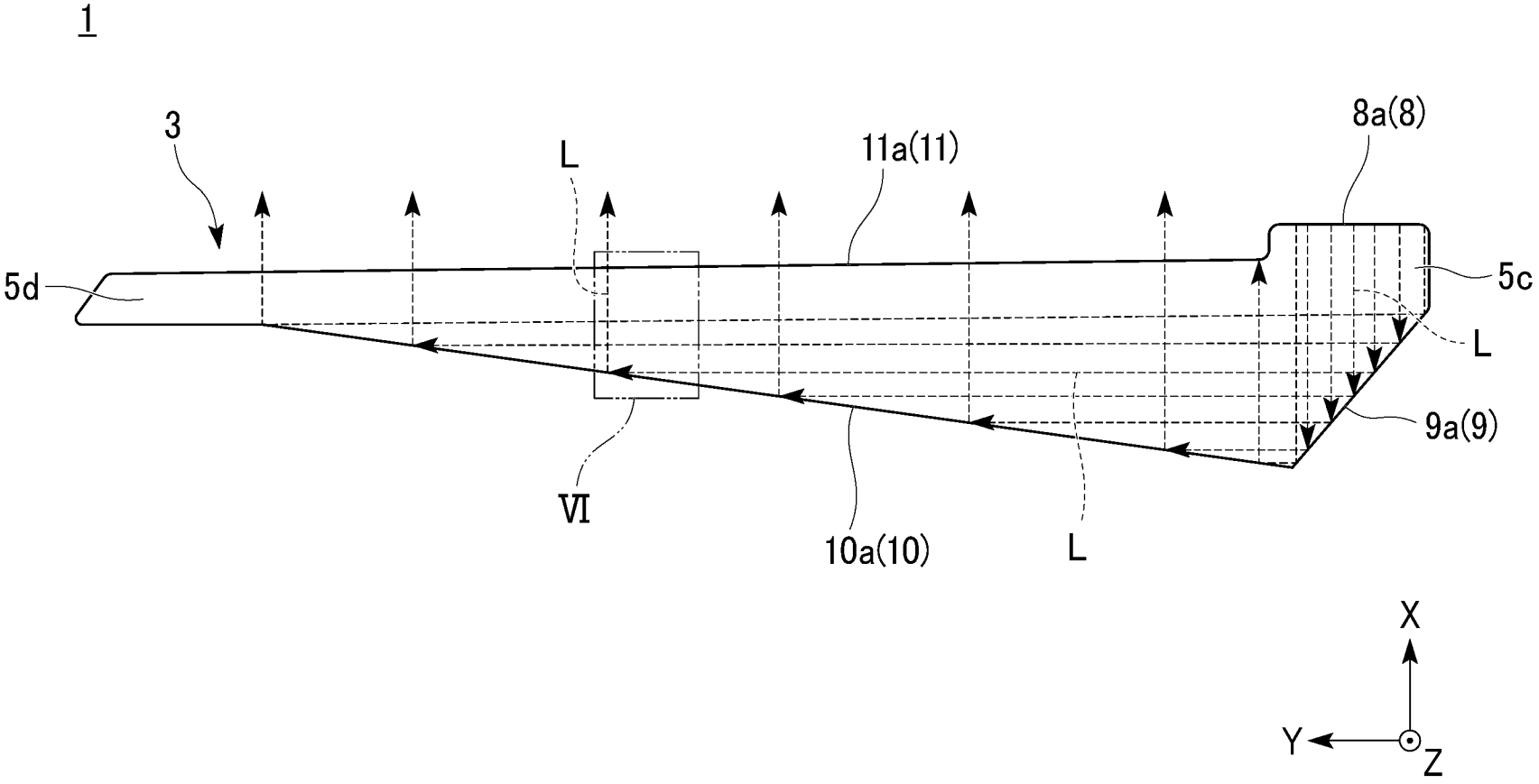
FIG. 4 is a cross-sectional view of the vehicle lamp along line segment IV-IV shown in FIG. 1.
Figure 5:
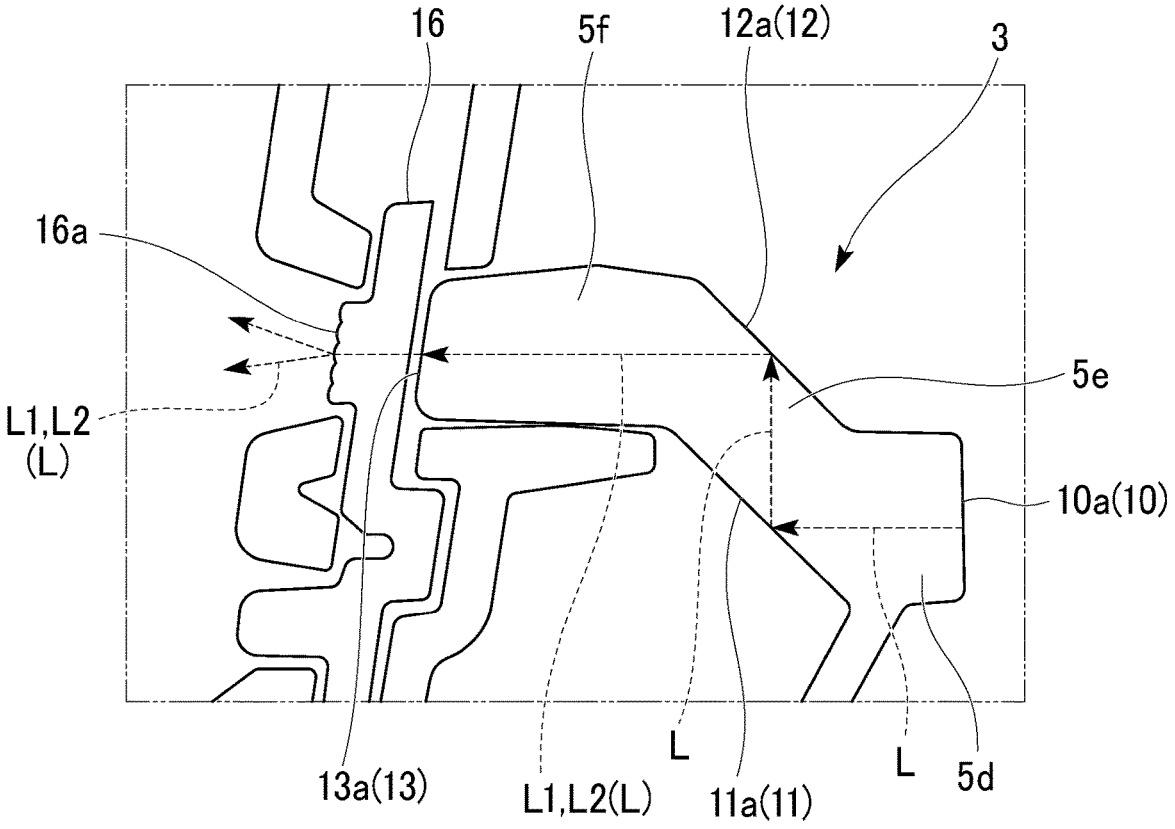
FIG. 5 is a cross-sectional view of the vehicle lamp along line segment V-V shown in FIG. 1.
Figure 6:
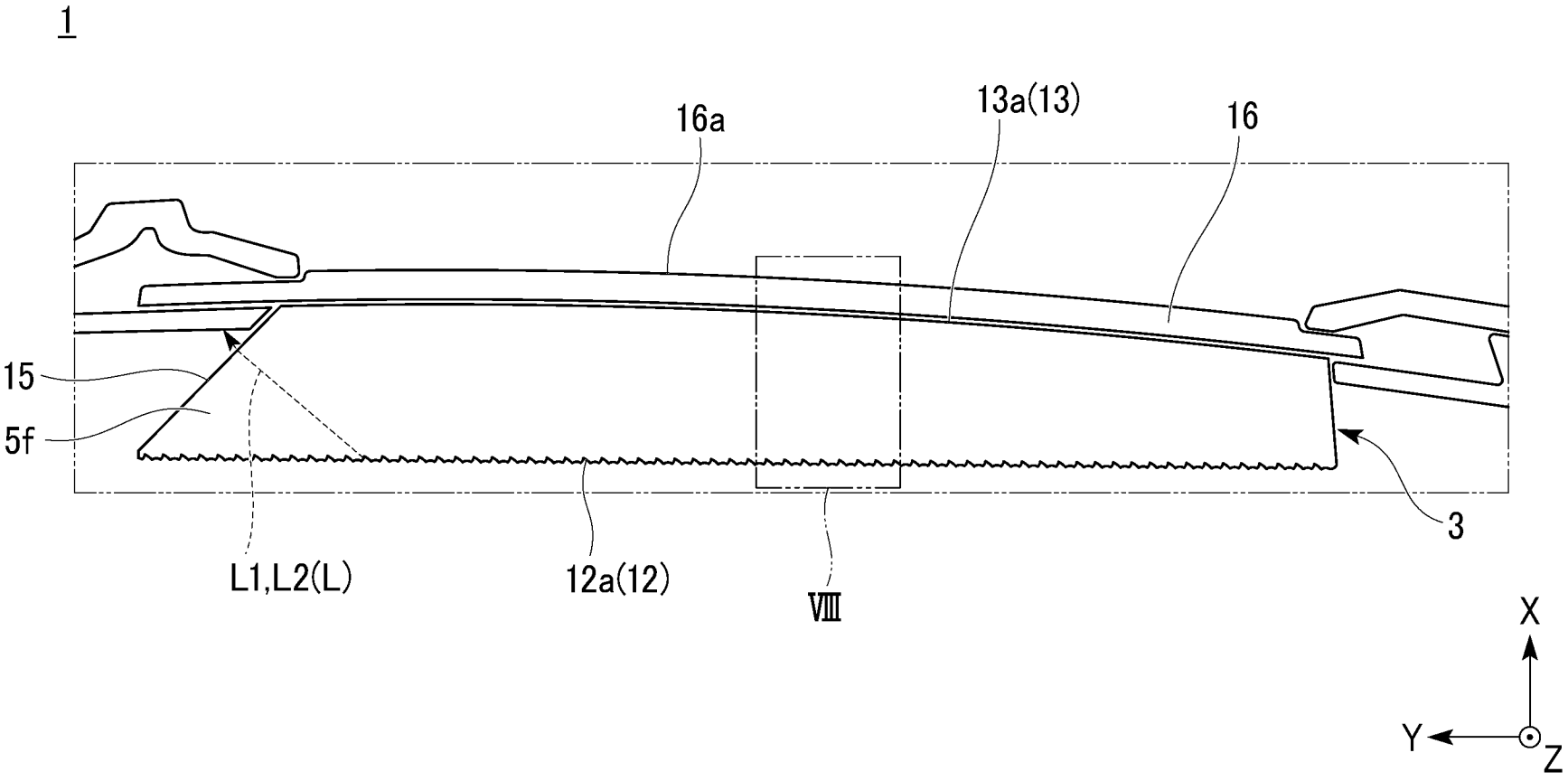
FIG. 6 is a cross-sectional view of the vehicle lamp along line segment VI-VI shown in FIG. 1.
Figure 7:
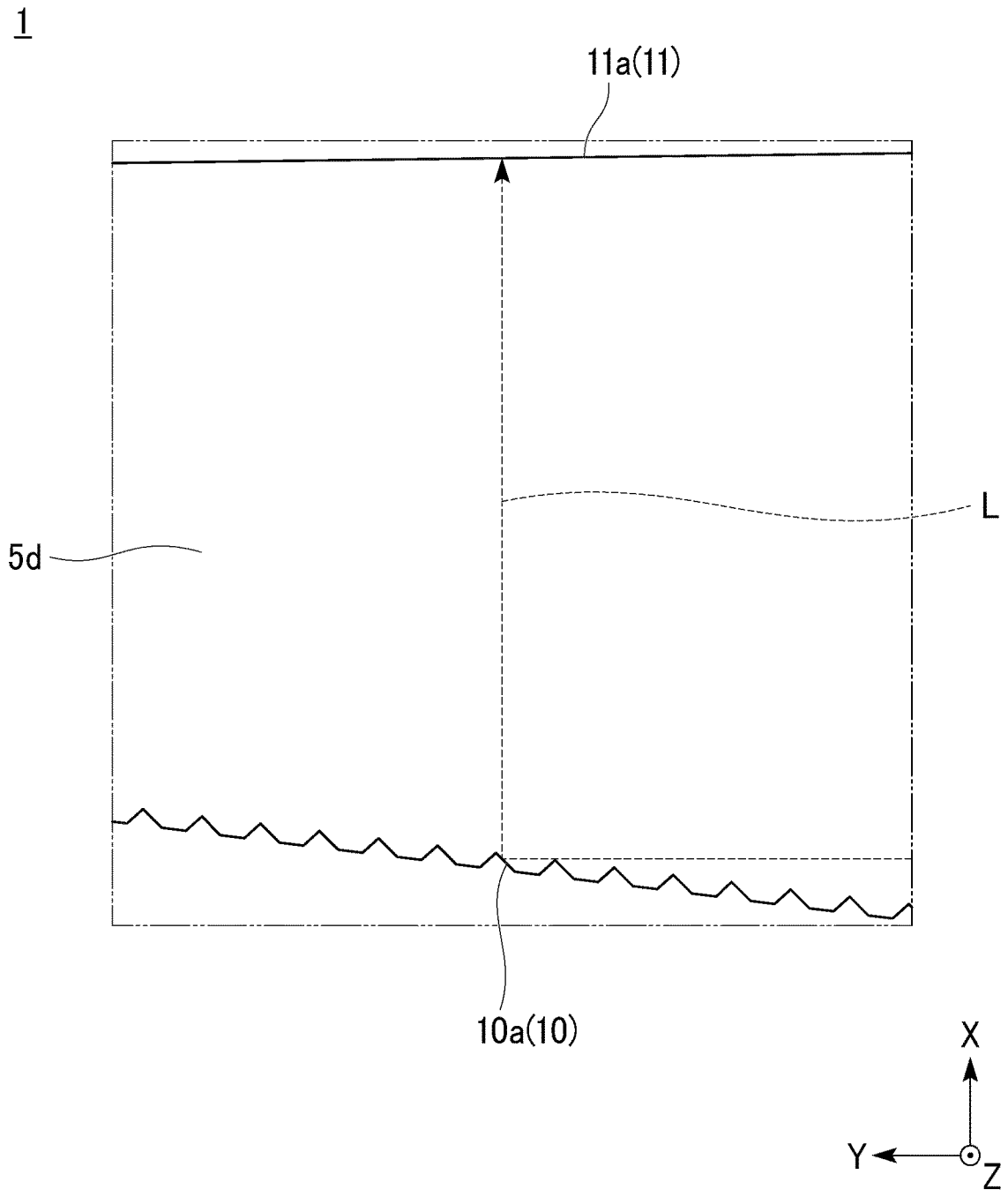
FIG. 7 is an enlarged cross-sectional view of a box portion VII shown in FIG. 4.
Figure 8:
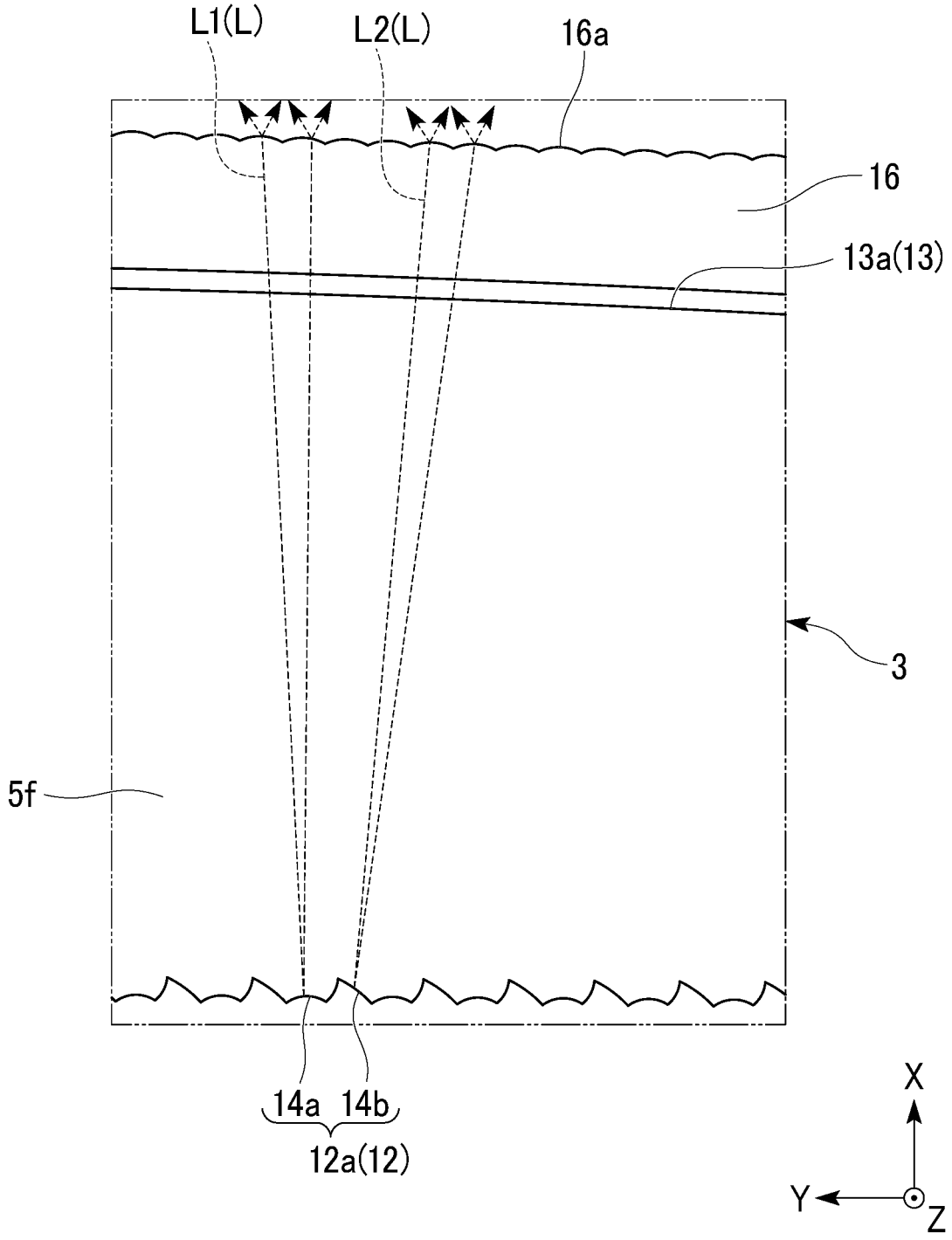
FIG. 8 is an enlarged cross-sectional view of a box portion VIII shown in FIG. 6.

As an embodiment of the present invention, for example, a vehicle lamp 1 shown in FIG. 1 to FIG. 8 will be described. Further, FIG. 1 is a rear view showing the configuration of the vehicle lamp 1. FIG. 2 is a side view showing the configuration of the vehicle lamp 1. FIG. 3 is a cross-sectional view of the vehicle lamp along line segment III-III shown in FIG. 1. FIG. 4 is a cross-sectional view of the vehicle lamp along line segment IV-IV shown in FIG. 1. FIG. 5 is a cross-sectional view of the vehicle lamp along line segment V-V shown in FIG. 1. FIG. 6 is a cross-sectional view of the vehicle lamp along line segment VI-VI shown in FIG. 1. FIG. 7 is an enlarged cross-sectional view of a box portion VII shown in FIG. 4. FIG. 8 is an enlarged cross-sectional view of a box portion VIII shown in FIG. 6.

In addition, in the following drawings, an XYZ orthogonal coordinate system is set, in which an X-axis direction indicates a leftward/rightward direction (a widthwise direction) of the vehicle lamp 1, a Y-axis direction indicates a forward/rearward direction (a lengthwise direction) of the vehicle lamp 1, and a Z-axis direction indicates an upward/downward direction (a height direction) of the vehicle lamp 1.

The vehicle lamp 1 of the embodiment is mounted on, for example, both corner portions of a front end side (in the embodiment, a corner portion of a left front end side) of a vehicle (not shown), and the present invention may be applied to side markers configured to emit orange light on sides of the vehicle.

Further, directions of forward, rearward, leftward, rightward, upward and downward, in the following description are directions when the vehicle lamp 1 is seen from a front surface (a side of the vehicle) unless the context clearly indicates otherwise.

Specifically, as shown in FIG. 1 and FIG. 2, the vehicle lamp 1 includes a light source 2, and a light guide body 3 configured to guide light L emitted from the light source 2.

The light source 2 is constituted by a light emitting diode (LED) configured to emit orange light (hereinafter, simply referred to as "light") L. The light source 2 is mounted on the side of one surface (in the embodiment, a front surface) of a circuit board 4 on which a driving circuit configured to drive the LED is provided. In addition, the circuit board 4 is disposed in a state in which the one surface is directed to the side of the vehicle (a+X axis side). Accordingly, the light source 2 emits the light L toward the side of the vehicle (the +X axis side).

Further, while the circuit board 4 has the configuration in which the driving circuit configured to drive the LED is provided, a configuration in which a mounting board on which the LED is provided and a circuit board on which the driving circuit is provided are separately disposed, the mounting board and the circuit board are electrically connected via a wiring cord that is referred to as a harness, and the driving circuit is protected from heat emitted from the LED may be provided.

The light guide body 3 is constituted by a light transmissive member configured to guide the light L emitted from the light source 2. For example, a material having a higher refractive index than air, for example, a transparent resin such as polycarbonate, acryl, or the like, glass, or the like, may be used in the light transmissive member.

The light guide body 3 includes a first light guide section 5*a*, a second light guide section 5*b*, a third light guide section 5*c*, a fourth light guide section 5*d*, a fifth light guide section 5*e*, a sixth light guide section 5*f*, an incidence section 6, a first reflecting section 7, a second reflecting section 8, a third reflecting section 9, a fourth reflecting section 10, a fifth reflecting section 11, a sixth reflecting section 12, and an emitting section 13.

As shown in FIG. 2 and FIG. 3, the first light guide section 5*a* constitutes a portion configured to guide the light L toward the side of the vehicle (the +X axis side) between the incidence section 6 located on one end side (a −X axis side) of the first light guide section 5*a* and the first reflecting section 7 located on the other end side (the +X axis side) of the first light guide section 5*a*.

As shown in FIG. 2 and FIG. 3, the second light guide section 5*b* constitutes a portion configured to guide the light L toward an upper side of the vehicle (a+Z axis side) between the first reflecting section 7 located on the one end side (a −Z axis side) of the second light guide section 5*b* and the second reflecting section 8 located on the other end side (the +Z axis side) of the second light guide section 5*b*.

As shown in FIG. 2, FIG. 3 and FIG. 4, the third light guide section 5*c* constitutes a portion configured to guide the light L in a direction opposite to the side of the vehicle (the −X axis side) between the second reflecting section 8 located on the one end side (the +X axis side) of the third light guide section 5*c* and the third reflecting section 9 located on the other end side (the −X axis side) of the third light guide section 5*c*.

As shown in FIG. 2 and FIG. 4, the fourth light guide section 5*d* constitutes a portion configured to guide the light L reflected by the third reflecting section 9 from one end side (a −Y axis side) toward the other end side (a+Y axis side) toward a rear side of the vehicle (the +Y axis side), and to guide the light L reflected by the fourth reflecting section 10 toward the side of the vehicle (the +X axis side) between the fourth reflecting section 10 located on the back surface side (the −X axis side) of the fourth light guide section 5*d* and the fifth reflecting section 11 located on the front surface side (the +X axis side) of the fourth light guide section 5*d*.

As shown in FIG. 2 and FIG. 5, the fifth light guide section 5*e* constitutes a portion configured to guide the light L toward an upper side of the vehicle (the +Z axis side) between the fifth reflecting section 11 located on the one end side (the −Z axis side) of the fifth light guide section 5*e* and the sixth reflecting section 12 located on the other end side (the +Z axis side) of the fifth light guide section 5*e*.

As shown in FIG. 2, FIG. 5 and FIG. 6, the sixth light guide section 5*f* constitutes a portion configured to guide the light L toward the side of the vehicle (the +X axis side) between the sixth reflecting section 12 located on the one end side (the −X axis side) of the sixth light guide section 5*f* and the emitting section 13 located on the other end side (the +X axis side) of the sixth light guide section 5*f*.

As shown in FIG. 2 and FIG. 3, the incidence section 6 constitutes a portion located on the side opposite to one surface of the circuit board 4 (in the embodiment, the back surface side), and configured to cause the light L emitted from the light source 2 to enter the light guide body 3.

Specifically, the incidence section 6 has a first condensed light incidence surface 6*a* located at a center of the portion facing the light source 2 and from which some of the light L emitted from the light source 2 enters, a second condensed light incidence surface 6*b* located on an inner circumferential surface of a protrusion protruding from a position surrounding the first condensed light incidence surface 6*a* toward the light source 2 and from which some of the light L emitted from the light source 2 enters, and a condensed light reflecting surface 6*c* located on an outer circumferential surface of the protrusion and configured to reflect the light L that has entered from the second condensed light incidence surface 6*b*.

In the incidence section 6, among the light L emitted from the light source 2, the light L that has entered from the first condensed light incidence surface 6*a* is condensed close to an optical axis. On the other hand, the light L that has entered from the second condensed light incidence surface 6*b* is reflected by the condensed light reflecting surface 6*c* and condensed close to the optical axis.

Accordingly, in the incidence section 6, the light L radially emitted forward from the light source 2 enters the first light guide section 5*a* while parallelizing (collimating) the light L. The light L that has entered the first light guide section 5*a* is guided toward the first reflecting section 7.

As shown in FIG. 2 and FIG. 3, the first reflecting section 7 has a first reflecting surface 7*a* inclined between the first light guide section 5*a* and the second light guide section 5*b*. In the first reflecting section 7, the light L that has entered the first reflecting surface 7*a* is reflected toward the second light guide section 5*b*. The light L that has entered the second light guide section 5*b* is guided toward the second reflecting section 8.

As shown in FIG. 2, FIG. 3 and FIG. 4, the second reflecting section 8 has a second reflecting surface 8*a* inclined between the second light guide section 5*b* and the third light guide section 5*c*. In the second reflecting section 8, the light L that has entered the second reflecting surface 8*a* is reflected toward the third light guide section 5*c*. The light L that has entered the third light guide section 5*c* is guided toward the third reflecting section 9.

As shown in FIG. 2, FIG. 3 and FIG. 4, the third reflecting section 9 has a third reflecting surface 9*a* inclined between the third light guide section 5*c* and the fourth light guide section 5*d*. In the third reflecting section 9, the light L that has entered the third reflecting surface 9*a* is reflected toward the fourth light guide section 5*d*. The light L that has entered the fourth light guide section 5*d* is guided toward the fourth reflecting section 10.

As shown in FIG. 2, FIG. 4 and FIG. 7, the fourth reflecting section 10 has a plurality of reflection cuts 10*a* located on the back surface side of the fourth light guide section 5*d* and configured to reflect the light L, which is guided from one end side of the fourth light guide section 5*d* toward the other end side of the fourth light guide section 5*d*, toward the front surface side. In addition, the back surface of the fourth light guide section 5*d* is inclined toward the front surface side of the fourth light guide section 5*d*.

The plurality of reflection cuts 10*a* are constituted by groove portions that cut the back surface of the fourth light guide section 5*d* in the upward/downward direction and are periodically arranged in a direction in which the fourth light guide section 5*d* extends. In the fourth reflecting section 10, the light L entering the plurality of reflection cuts 10*a* is reflected toward the front surface side of the fourth light guide section 5*d*. The light L reflected by the plurality of reflection cuts 10*a* is guided toward the fifth reflecting section 11.

Further, the fourth reflecting section 10 is not particularly limited to the above-mentioned configuration, and the light L entering the back surface side of the fourth light guide section 5*d* may be finally reflected toward the emitting section 13, which is horizontally long, from the front surface side of the fourth light guide section 5*d*.

In addition, the back surface of the fourth light guide section 5*d* has a limited angle to be tilted in order to achieve thinning of the light guide body 3. Accordingly, in the fourth reflecting section 10, it is preferable to appropriately adjust the shape, size, number, or the like, of the reflection cuts 10*a* to uniformly reflect the light L, which is guided from one end side of the fourth light guide section 5*d* toward the other end side of the fourth light guide section 5*d*, toward the front surface side.

As shown in FIG. 2 and FIG. 5, the fifth reflecting section 11 has a fifth reflecting surface 11*a* inclined between the fourth light guide section 5*d* and the fifth light guide section 5*e*. In the fifth reflecting section 11, the light L that has entered the fifth reflecting surface 11*a* is reflected toward the fifth light guide section 5*e*. The light L that has entered the fifth light guide section 5*e* is guided toward the sixth reflecting section 12.

As shown in FIG. 2, FIG. 5, FIG. 6 and FIG. 8, the sixth reflecting section 12 has a sixth reflecting surface 12*a* inclined between the fifth light guide section Se and the sixth light guide section 5*f*. In the sixth reflecting section 12, the light L that has entered the sixth reflecting surface 12*a* is reflected toward the sixth light guide section 5*f*. The light L that has entered the sixth light guide section 5*f* is guided toward the emitting section 13.

In addition, a plurality of reflection cuts 14*a* and 14*b* are provided on the sixth reflecting surface 12*a*. The plurality of reflection cuts 14*a* and 14*b* are constituted by groove portions that cut the sixth reflecting surface 12*a* in a longitudinal direction and periodically arranged in the direction in which the sixth light guide section 5*f* extends.

In addition, the plurality of reflection cuts 14*a* and 14*b* are constituted by a first reflection cut 14*a* configured to reflect the light L1, which is among the light L that has entered the sixth reflecting surface 12*a*, in one direction in the front surface side of the sixth light guide section 5*f* (in the embodiment, toward the side of the vehicle), and a second reflection cut 14*b* configured to reflect light L2 in the other direction different from the one direction in the front surface side of the sixth light guide section 5*f* (in the embodiment, 45° forward from the side of the vehicle), which are alternately arranged.

In addition, the first reflection cut 14*a* and the second reflection cut 14*b* have a curved shape in order to diffuse the lights L1 and L2 that has been reflected by the first reflection cut 14*a* and the second reflection cut 14*b*.

Further, the fifth reflecting section 11 and the sixth reflecting section 12 may be configured to have a diffusing function of diffusing the reflected light L. Accordingly, it is possible to further uniformize the light L guided toward the emitting section 13.

A transmissive surface 15 is provided on an end portion of the sixth light guide section 5*f* corresponding to the other end side of the fourth light guide section 5*d*. The transmissive surface 15 is constituted by an inclined surface obtained by diagonally cutting the end portion of the sixth light guide section 5*f*.

In the sixth light guide section 5*f*, the light L that has entered the transmissive surface 15 is transmitted to the outside of the sixth light guide section 5*f*. Accordingly, the light L that has entered the end portion of the sixth light guide section 5*f* is prevented from being reflected toward the emitting section 13 that is in the front surface side of the sixth light guide section 5*f*. Accordingly, in the vehicle lamp 1 of the embodiment, it is possible to prevent the light L that has entered the end portion of the sixth light guide section 5*f* from being emitted from the emitting section 13 and deteriorating the appearance.

As shown in FIG. 2, FIG. 5, FIG. 6 and FIG. 8, the emitting section 13 constitutes a portion located on a side opposite to the side facing the one surface of the circuit board 4 (in the embodiment, the front surface side) and configured to emit the light L that has entered from the incidence sections to the outside of the light guide body 3.

Specifically, the emitting section 13 has a light emitting surface 13*a* provided on the front surface side of the sixth light guide section 5*f*. The light emitting surface 13*a* is provided to be curved throughout the direction in which the sixth light guide section 5*f* extends. In the emitting section 13, the light L1 that has been reflected by the first reflection cut 14*a* is emitted from the light emitting surface 13*a* in the one direction (in the embodiment, toward the side of the vehicle), and the light L2 that has been reflected by the second reflection cut 14*b* is emitted from the light emitting surface 13*a* in the other direction different from the one direction (in the embodiment, 45° forward from the side of the vehicle).

A diffusion lens 16 is provided in front of the light emitting surface 13*a* (the emitting section 13). The diffusion lens 16 is formed of a flat light transmissive member and disposed to face the light emitting surface 13*a*. For the diffusion lens 16, the same light transmissive member as exemplified as the light guide body 3 can be used.

As shown in FIG. 5, FIG. 6 and FIG. 8, the diffusion lens 16 has a diffusion surface 16*a* that diffuses and transmits the lights L1 and L2 that has been emitted from the light emitting surface 13*a* (the emitting section 13). In the embodiment, the diffusion surface 16*a* is provided on the side (front surface side) opposite to the side (back surface side) facing the light emitting surface 13*a* of the diffusion lens 16. Further, the diffusion surface 16*a* may be provided on the side (back surface side) opposite to the light emitting surface 13*a* of the diffusion lens 16.

The diffusion surface 16*a* has a concavo-convex structure configured to diffuse the lights L1 and L2. Further, as such a concavo-convex structure, for example, a concavo-convex structure or the like formed by performing lens cutting referred to as flute cutting or fisheye cutting, knurling, embossing, or the like may be exemplified. Further, in the embodiment, the fisheye cutting is provided as the diffusion surface 16*a*.

In the diffusion lens 16, it is possible to control the diffusion level of the lights L1 and L2 emitted from the diffusion lens 16 by adjusting the shape or the like of the diffusion surface 16*a*.

In the vehicle lamp 1 of the embodiment having the above-mentioned configuration, orange light can be emitted using the front surface side of the diffusion lens 16 as a light emitting surface S of the side marker.

Further, while the configuration using the diffusion lens 16 has been exemplified in the embodiment, the diffusion lens 16 may be omitted and the orange light can also be emitted using the light emitting surface 13*a* (the emitting section 13) of the light guide body 3 as the light emitting surface S of the side marker.

Incidentally, in the vehicle lamp 1 of the embodiment, the incidence section 6 of the light guide body 3 is located on the side (back surface side) opposite to the one surface of the circuit board 4, and is disposed inside of a region where the light guide body 3 overlaps with the circuit board 4 when seen in a plan view. Meanwhile, the emitting section 13 of the light guide body 3 is located on the side (front surface side) opposite to the side facing the one surface of the circuit board 4, and is disposed outside of the region where the light guide body 3 overlaps with the circuit board 4 when seen in a plan view.

Accordingly, the first to sixth light guide sections 5*a* to 5*f* of the light guide body 3 are located between the incidence section 6 and the emitting section 13, and disposed across the inside and the outside of the region where the light guide body 3 overlaps with the circuit board 4 when seen in a plan view. Further, the third light guide section 5*c* constitutes a portion located at an outer side of the region where the light guide body 3 overlaps with the circuit board 4 when seen in a plan view, and extending from the one side (front surface side) toward the other side (back surface side) of the circuit board 4 in at least a thickness direction of the circuit board 4. In addition, in the third light guide section 5*c*, a dimension of the portion extending from the one side toward the other side of the circuit board 4 is maximized in the thickness direction of the light guide body 3.

That is, the light guide body 3 has a shape passing through the side of the circuit board 4 from the one surface (front surface) side of the circuit board 4, bypassing toward the other surface (back surface) of the circuit board 4, and then, extending in a direction in which a width of the lights L1 and L2 (L) emitted from the emitting section 13 is widened (the forward/rearward direction of the vehicle) in order to achieve reduction in thickness of the light guide section between the incidence section 6 and the emitting section 13 (in the embodiment, the first to sixth light guide sections 5*a* to 5*f*).

Accordingly, in the vehicle lamp 1 of the embodiment, it is possible to achieve reduction in thickness of the first to sixth light guide sections 5*a* to 5*f* (the light guide body 3) in the thickness direction of the circuit board 4 while the direction of the light L emitted from the light source 2 matches with the direction of the lights L1 and L2 (L) emitted from the emitting section 13 of the light guide body 3. In addition, even when the light source 2 is located at a position separated from the light emitting surface S in the upward/downward direction of the vehicle lamp 1, it is possible to minimize the entire thickness of the vehicle lamp 1 regardless of the size of the circuit board 4.

In addition, in the vehicle lamp 1 of the embodiment, in the fourth to sixth light guide sections 5*d* to 5*f* located at the outer side of the region where the light guide body 3 overlaps with the circuit board 4 of the light guide body 3 when seen in a plan view, it is possible for the light emitting surface S to more emit light uniformly while increasing the width of the lights L1 and L2 (L) emitted from the emitting section 13 in the forward/rearward direction of the vehicle.

Specifically, in the vehicle lamp 1, in the above-mentioned light guide body 3, the light L, which is reflected by the third reflecting section 9 and guided from the one end side to the other end side of the fourth light guide section 5*d*, is reflected by the fourth reflecting section 10, and thus, the width of the lights L1 and L2 (L) emitted from the emitting section 13 can be increased in the forward/rearward direction of the vehicle.

In addition, in the vehicle lamp 1 of the embodiment, in the above-mentioned light guide body 3, the light L1 emitted from the light emitting surface 13*a* in the one direction (in the embodiment, the side of the vehicle) and the light L2 emitted from the light emitting surface 13*a* in the other direction different from the one direction (in the embodiment, 45° forward from the side of the vehicle) are diffused and reflected by the plurality of reflection cuts 14*a* and 14*b* provided on the sixth reflecting section 12, respectively, and thus, it is possible to cause the light emitting surface S to more emit light uniformly.

Further, in the vehicle lamp 1 of the embodiment, as a stepped portion is provided between the fourth light guide section 5*d* and the sixth light guide section 5*f* via the fifth light guide section 5*e*, since the light L reflected from the side of the emitting section 13 at the fourth reflecting section 10 (the plurality of reflection cuts 10*a*) is not directly seen, it is possible to prevent the appearance from being deteriorated by the blinking.

As a result, in the vehicle lamp 1 of the embodiment, it is possible to improve the appearance upon emission as well as to reduce the entire thickness. In addition, it is possible to cause the horizontally long light emitting surface S to emit light uniformly using one light source 2. In particular, in the vehicle lamp 1 of the embodiment, even when the light emitting surface S is seen in any direction, it is possible to cause the light emitting surface S to emit light uniformly.

Further, the present invention is not particularly limited to the embodiment, and various modifications may be made without departing from the scope of the present invention.

For example, while the case in which the present invention is applied to the above-mentioned side marker on the front side has been exemplified in the embodiment, the vehicle lamp to which the present invention is applied is not particularly limited to the above-mentioned side marker on the front side and may be applied to a side marker on the rear side.

In addition, in the vehicle lamp to which the present invention is applied, in addition to the above-mentioned side marker, for example, the present invention may be widely applied to the vehicle lamp on the rear side or the front side, such as a tail lamp, a brake lamp (stop lamp), a direction indicator (turn lamp), a back lamp, a day running light (DRL), a width indicator (position lamp), or the like. In addition, in addition to the above-mentioned orange light, the color of the light emitted from the light source may be appropriately changed according to the application of the vehicle lamp such as red light, white light, or the like.

Further, when the present invention is applied to the above-mentioned side marker on the front side, in addition to the above-mentioned configuration, for example, the present invention can be combined with other members such as an outer lens, an extension, or the like.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A vehicle lamp comprising:

a light source provided on one surface of a board; and a light guide body configured to guide light emitted from the light source, wherein the light guide body has:

an incidence section located on a side of the light guide body facing the one surface of the board and from which the light emitted from the light source enters;

an emitting section located on a side opposite to the side facing the one surface of the board and through which light that has entered from the incidence section is emitted to an outside;

a light guide section that is located between the incidence section and the emitting section and that is configured to guide light from the incidence section toward the emitting section, wherein the incidence section is disposed inside of a region where the light guide body overlaps with the board when seen in a plan view, the emitting section is disposed outside of the region where the light guide body overlaps with the board when seen in the plan view, the light guide section has a portion that extends across the inside and the outside of the region where the light guide body overlaps with the board when seen in the plan view, that extends at an outer side of the region where the light guide body overlaps with the board when seen in the plan view, and that extends from one side toward other side of the board in at least a thickness direction of the board, wherein the light guide body comprises at least:

a first light guide section, a second light guide section, a third light guide section and a fourth light guide section;

a first reflecting section that is located between the first light guide section and the second light guide section and that is configured to reflect light, which has been entered from the incidence section and which is guided inside of the first light guide section, toward the second light guide section;

a second reflecting section that is located between the second light guide section and the third light guide section and that is configured to reflect light, which is guided inside of the second light guide section, toward the third light guide section;

a third reflecting section that is located between the third light guide section and the fourth light guide section and that is configured to reflect light, which is guided inside of the third light guide section, toward the fourth light guide section; and a fourth reflecting section that is located on a back surface side of the fourth light guide section and that is configured to reflect light, which is guided inside of the fourth light guide section, toward a front surface side of the fourth light guide section, and the third light guide section constitutes the portion that extends from the one side toward the other side of the board.

2. The vehicle lamp according to claim 1, wherein the fourth reflecting section has a plurality of reflection cuts provided on the back surface side of the fourth light guide section, and the plurality of reflection cuts reflect light, which is guided from one end side toward other end side of the fourth light guide section, toward the front surface side of the fourth light guide section.

3. The vehicle lamp according to claim 2, wherein the light guide body comprises:

a fifth light guide section and a sixth light guide section;

a fifth reflecting section that is located between the fourth light guide section and the fifth light guide section and that is configured to reflect light, which is guided toward the front surface side of the fourth light guide section, toward the fifth light guide section; and a sixth reflecting section that is located between the fifth light guide section and the sixth light guide section and that is configured to reflect light, which is guided inside of the fifth light guide section, toward the sixth light guide section, the sixth reflecting section has a plurality of reflection cuts, and the plurality of reflection cuts are constituted by a first reflection cut configured to reflect light in one direction at a front surface side of the sixth light guide section and a second reflection cut configured to reflect light in another direction different from the one direction at the front surface side of the sixth light guide section, which are alternately arranged.

4. The vehicle lamp according to claim 3, wherein a transmissive surface configured to transmit light is provided on an end portion of the sixth light guide section corresponding to the other end side of the fourth light guide section.

5. The vehicle lamp according to claim 1, comprising a diffusion lens disposed so as to face the emitting section of the light guide body, wherein the diffusion lens has a diffusion surface configured to diffuse and transmit the light emitted from the emitting section.

6. The vehicle lamp according to claim 1, wherein a direction of the light emitted from the light source matches with a direction of light emitted from the emitting section.

7. The vehicle lamp according to claim 6, wherein the light source is a light emitting diode, and the vehicle lamp is any one of a side marker lamp, a tail lamp, a brake lamp (stop lamp), a direction indicator (turn lamp), a back lamp, a day running light (DRL), a width indicator (position lamp).

8. The vehicle lamp according to claim 1, wherein a dimension of a portion that extends from the one side toward the other side of the board is maximized in the light guide body in a thickness direction of the light guide body.

9. The vehicle lamp according to claim 1, wherein the light source is a light emitting diode, and the vehicle lamp is any one of a side marker lamp, a tail lamp, a brake lamp (stop lamp), a direction indicator (turn lamp), a back lamp, a day running light (DRL), a width indicator (position lamp).

10. A vehicle lamp comprising:

a light source provided on one surface of a board;

a light guide body configured to guide light emitted from the light source, wherein the light guide body has:

an incidence section located on a side of the light guide body facing the light source, from which light emitted from the light source enters and which condenses entered light;

an emitting section located away from the incidence section and through which light that has entered from the incidence section is emitted to an outside; and a light guide section that is located between the incidence section and the emitting section and that is configured to guide light from the incidence section toward the emitting section, wherein the incidence section is disposed inside of a region where the light guide body overlaps with the board when the board is seen from a side of an other surface of the board which is an opposite side of the one surface, the emitting section is disposed outside of the region where the light guide body overlaps with the board when the board is seen from the side of the other surface of the board which is the opposite side of the one surface, the light guide section is disposed at a portion that extends across the inside and the outside of the region where the light guide body overlaps with the board when the board is seen from the side of the other surface of the board which is the opposite side of the one surface, and the light guide section has a bypass section that passes through a side of the board, that extends from one side of the board toward an other side of the board in a thickness direction of the board, and that is configured to bypass light, which has entered the incidence section and which is guided inside of the light guide section, from the one surface side of the board to the other surface side of the board.

11. The vehicle lamp according to claim 10, wherein the light guide body comprises:

a reflecting surface that is located between the bypass section and the emitting section and that forms a plurality of reflection cuts that are configured to reflect light guided inside of the bypass section toward the emitting section, the plurality of reflection cuts includes a first reflection cut which reflects light that has entered toward the emitting section in one direction and a second reflection cut which reflects light that has entered toward the emitting section in other direction different from the one direction.

12. The vehicle lamp according to claim 11, wherein a direction of the light emitted from the light source matches with a direction of light emitted from the emitting section.

13. The vehicle lamp according to claim 12, wherein a dimension of the portion that extends from the one side toward the other side of the board is maximized in the light guide body in a thickness direction of the light guide body.

14. The vehicle lamp according to claim 13, wherein the light source is a light emitting diode, and the vehicle lamp is any one of a side marker lamp, a tail lamp, a brake lamp, a turn signal lamp, a back lamp, a day running light (DRL), and a width indicator lamp.

15. The vehicle lamp according to claim 12, wherein the light source is a light emitting diode, and the vehicle lamp is any one of a side marker lamp, a tail lamp, a brake lamp, a turn signal lamp, a back lamp, a day running light (DRL), and a width indicator lamp.

16. The vehicle lamp according to claim 11, wherein a dimension of the portion that extends from the one side toward the other side of the board is maximized in the light guide body in a thickness direction of the light guide body.

17. The vehicle lamp according to claim 16, wherein the light source is a light emitting diode, and the vehicle lamp is any one of a side marker lamp, a tail lamp, a brake lamp, a turn signal lamp, a back lamp, a day running light (DRL), and a width indicator lamp.

18. The vehicle lamp according to claim 11, wherein the light source is a light emitting diode, and the vehicle lamp is any one of a side marker lamp, a tail lamp, a brake lamp, a turn signal lamp, a back lamp, a day running light (DRL), and a width indicator lamp.

19. The vehicle lamp according to claim 10, wherein the light source is a light emitting diode, and the vehicle lamp is any one of a side marker lamp, a tail lamp, a brake lamp, a turn signal lamp, a back lamp, a day running light (DRL), and a width indicator lamp.

* * * * *